US007078957B2

(12) United States Patent
Kim et al.

(10) Patent No.: US 7,078,957 B2
(45) Date of Patent: Jul. 18, 2006

(54) INTERNAL VOLTAGE GENERATOR OF SEMICONDUCTOR DEVICE COMPRISING CHARACTERISTIC CONTROLLER

(75) Inventors: Kwang Hyun Kim, Mungyeong-si (KR); Young Jun Nam, Seoul (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 48 days.

(21) Appl. No.: 10/728,848

(22) Filed: Dec. 8, 2003

(65) Prior Publication Data

US 2004/0155701 A1 Aug. 12, 2004

(30) Foreign Application Priority Data

Feb. 10, 2003 (KR) ..... 10-2003-0008254

(51) Int. Cl.
*G05F 3/08* (2006.01)

(52) U.S. Cl. ..... 327/538; 327/543

(58) Field of Classification Search ..... 327/538–541, 327/543

See application file for complete search history.

(56) References Cited

U.S. PATENT DOCUMENTS 5,434,498 A * 7/1995 Cordoba et al. ..... 323/313
6,184,720 B1 * 2/2001 Kim et al. ..... 327/37
6,333,864 B1 * 12/2001 Nishimura et al. ..... 363/78
6,429,729 B1 * 8/2002 Kobayashi et al. ..... 327/540

FOREIGN PATENT DOCUMENTS

KR 10-0234492 12/1999

* cited by examiner

*Primary Examiner*—Timothy P. Callahan
*Assistant Examiner*—Terry L. Englund
(74) *Attorney, Agent, or Firm*—Heller Ehrman LLP

(57) ABSTRACT

An internal voltage generator of a semiconductor device features a tuning unit, a characteristic controller and an internal voltage generating unit. The tuning unit receives a test mode signal, an external signal and a signal stored in an internal setup device, and outputs a control signal. The characteristic controller receives the control signal, and outputs a characteristic controlling signal. The internal voltage generating unit receives a reference input signal and the characteristic controlling signal, and controls a characteristic of an internal voltage.

11 Claims, 15 Drawing Sheets

| FUSE-CUT | | FUSE-CONNECTED | |
|---|---|---|---|
| cut | cutb | cut | cutb |
| H | L | L | H |

INTERNAL VOLTAGE GENERATOR OF SEMICONDUCTOR DEVICE COMPRISING CHARACTERISTIC CONTROLLER

BACKGROUND OF THE INVENTION

1. Field of the Invention

The present invention generally relates to an internal voltage generator of a semiconductor device, and more specifically, to an internal voltage generator which is able to obtain a stable internal voltage by monitoring oscillation of an internal voltage caused by noise or variation of load and optimizing characteristics of an internal voltage generating circuit.

2. Description of the Prior Art

FIG. 1 shows a conventional internal voltage generator 1, a conventional address circuit 2 and a conventional data output circuit 3. The internal voltage generator 1, the address circuit 2 and the data output circuit 3 are separated as an individual circuit in the conventional memory devices.

The internal generator 1 comprises a band gap reference generator 10, a VR1 generator 20, a VR2 generator 30, a VRC generator 40 and a Vcore driver 50, which are connected in series. The Vcore driver 50 outputs a final internal voltage Vcore. The address circuit 2 comprises an address pad 60 and an address decoder 61. The data output circuit 3 comprises a Dout buffer 70 and a DQ pad 71.

In a conventional semiconductor device, mask level processes should be repeated in order to reflect test results performed on a fabricated semiconductor device. As a result, time and cost are additionally required. Even when tests are performed in the package level, extra test pins other than conventional address input pins or data output pins are required.

SUMMARY OF THE INVENTION

Accordingly, it is an object of the present invention to provide an internal voltage generator wherein address pads and data pads are used to regulate pole and zero points of a driver circuit included in an internal voltage generator in a test mode. Optimum RC model is selected by inputting selection address in the address pads, and monitoring values outputted from the data pads.

It is also an object of the present invention to minimize consumption of time and cost necessary for production by programming test results in a built-in fuse.

There is provided an internal voltage generator of a semiconductor device comprising a tuning unit, a characteristic controller and an internal voltage generating unit. The tuning unit receives a test mode signal, an external signal and a signal stored in an internal setup device, and outputs a control signal. The characteristic controller receives the control signal, and outputs a characteristic controlling signal. The internal voltage generating unit receives a reference input signal and the characteristic controlling signal, and controls a characteristic of an internal voltage.

DETAILED DESCRIPTION OF THE PREFERRED EMBODIMENTS

The present invention will be described in detail with reference to the accompanying drawings.

Figure 2:
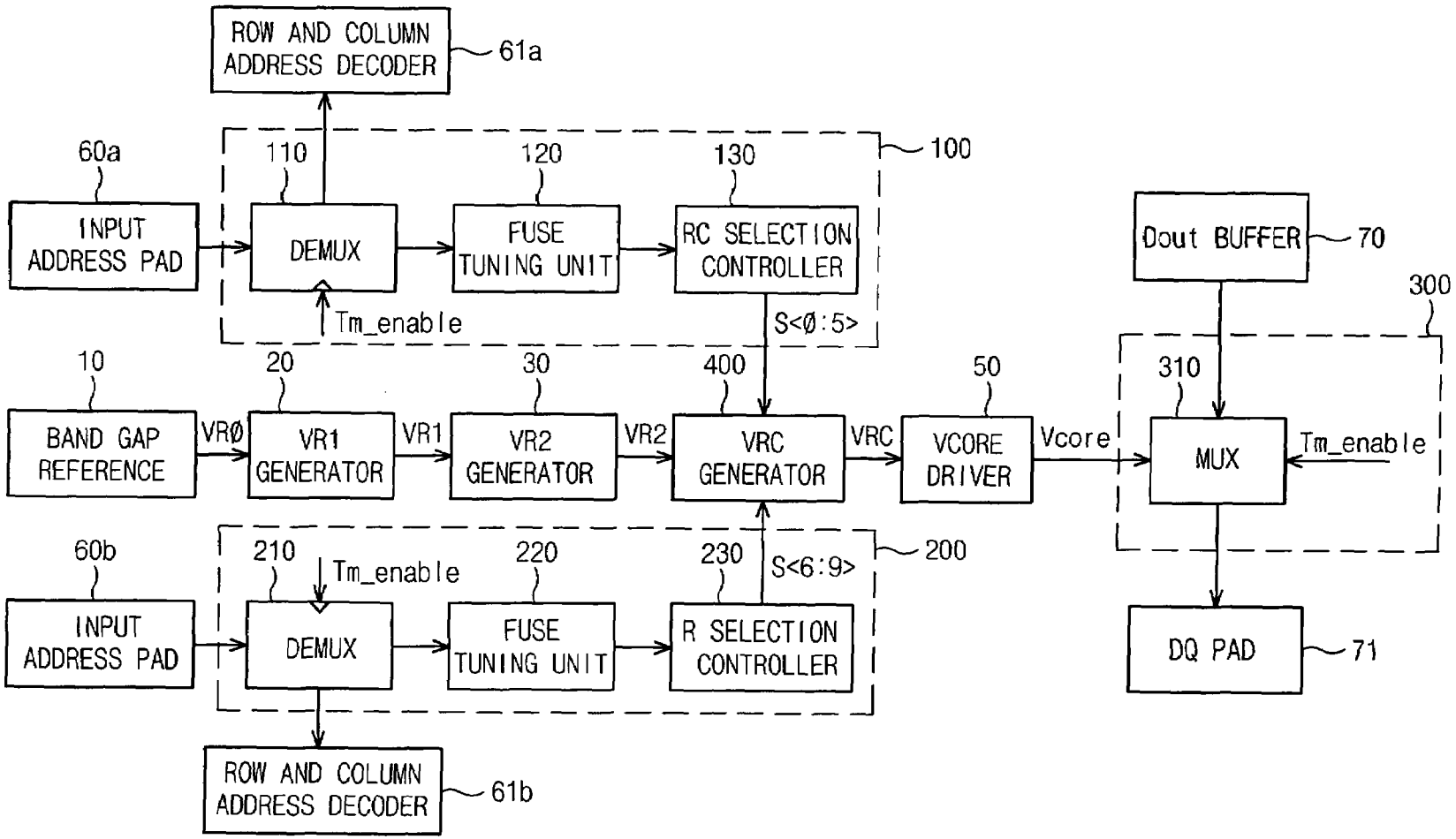
FIG. 2 is a block diagram illustrating an internal voltage generator according to an embodiment of the present invention.

FIG. 2 is a block diagram illustrating an internal voltage generator according to an embodiment of the present invention. In an embodiment, an internal voltage generator comprises an internal voltage generating unit (10, 20, 30, 50, 400), a first test mode block 100, a second test mode block 200 and a data output circuit 300.

The internal voltage generating unit (10, 20, 30, 50, 400) comprises a band gap reference generator 10, a VR1 Generator 20, a VR2 generator 30, a VRC generator 400 and a Vcore driver 50. The first test mode block 100 comprises a demultiplexer 110 and a RC selection controller 130. The demultiplexer 110 outputs a signal, which is inputted from an address pad 60*a*, into a row and column address decoder 61*a* or a fuse tuning unit 120 in response to a control signal Tm_enable. The RC selection controller 130 receives an output signal from the fuse tuning unit 120 and outputs a RC selection signal S<0:5>. The second test mode block 200 comprises a demultiplexer 210 and an R selection controller 230. The demultiplexer 210 outputs a signal, which is inputted from an address pad 60*b*, into a row and column address decoder 61*a* or a fuse tuning unit 220 in response to a control signal Tm_enable. The R selection controller 230 receives an output signal from the fuse tuning unit 220, and outputs an R selection signal S<6:9>. In a test mode, the fuse tuning units 120 and 220 output signals inputted through address pads into the RC selection controller 130 and the R selection controller 230. After the test mode, fuses are programmed according to the results of the test. Then, the fuse tuning units 120 and 220 output the programmed results into the RC selection controller 130 and the R selection controller 230.

The data output circuit 300 comprises a multiplexer 310 for outputting a signal, which is from the VCore driver 50 or the Dout buffer 70, into a DQ pad 71.

The VRC generator 400 regulates pole and zero points of a voltage generating circuit by using a selection signal S<0:5> outputted from the RC selection unit 130 and selection signal S<6:9> outputted from the R selection unit 230.

Figure 3:
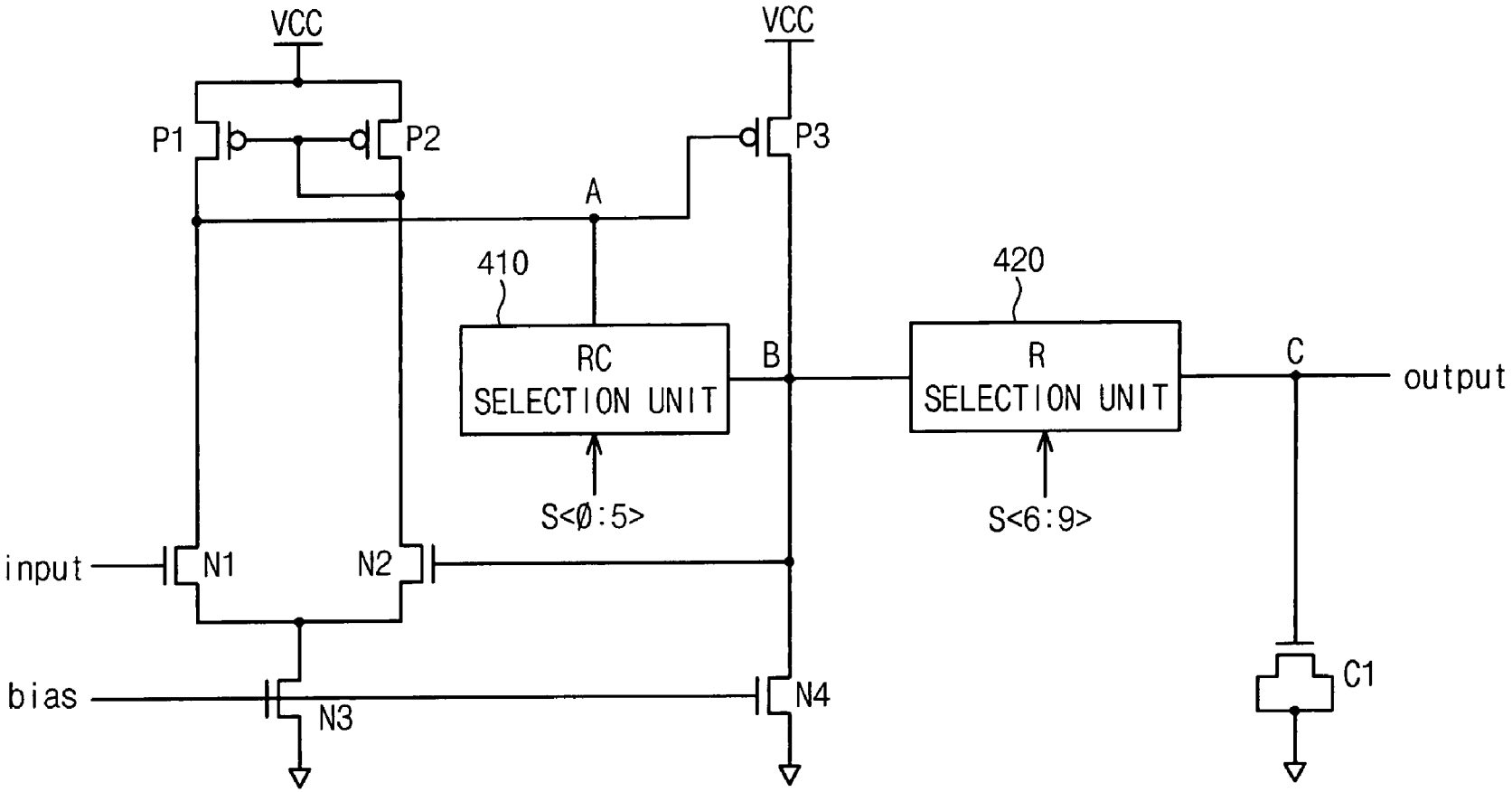
FIG. 3 is a circuit diagram illustrating a VRC generator of FIG. 2.

FIG. 3 is a circuit diagram illustrating the VRC generator 400 of FIG. 2. In the VRC generator 400, two-step amplifier is used. A first amplifier comprises PMOS transistors P1 and P2, and NMOS transistors N1, N2 and N3. The PMOS transistors P1 and P2 are formed as a current mirror type. The NMOS transistors N1 and N2 are connected to the current mirror and comprise a differential input unit. The NMOS transistor N3 receives a bias voltage. A second amplifier comprises a PMOS transistor P3 and a NMOS transistor N4.

A common source of the PMOS transistors P1 and P2 is connected to a power VCC, and a common gate of the PMOS transistors P1 and P2 is connected to a drain of the PMOS transistor P2. A drain of the PMOS transistor P1 is connected to a drain of the NMOS transistor N1, and the drain of the PMOS transistor P2 is connected to a drain of the NMOS transistor N2. A common source of the NMOS transistors N1 and N2 is connected to a drain of the NMOS transistor N3. A gate of the NMOS transistor N1 receives an input signal 'input'. An output unit B of the second amplifier is fed back to a gate of the NMOS transistor N2. A gate of the NMOS transistor N3 receives an input signal 'bias'. An output node of the first amplifier is the drain (A) of the PMOS transistor P1.

The PMOS transistor P3 has a gate connected to an output unit A of the first amplifier, a source connected to the power VCC, and a drain connected to the NMOS transistor N4. The NMOS transistor N4 has a gate to receive the input signal 'bias', and a source connected to ground.

The two-step amplifier is a system having two poles. Here, a phase margin of more than 60° should be secured for frequency stability. The phase margin refers to a difference between phase response and −180° when an amplitude response is 0 dB. In order to secure the phase margin of the system, a "Miller compensation method" is used to improve stability. Here, a capacitor is connected between input and output terminals of the second amplifier to separate two main poles. In the "Miller compensation method", a feed-forward path from a terminal A to a terminal B is formed. The feed-forward path causes a zero to be generated on a right half plane. A RC selection unit 410 where capacitors and resistors are connected in series is used to remove the zero point. Additionally, an R selection unit 420 connected between the terminal (B) and an output terminal in cooperation with a capacitor C1 connected between the output terminal and ground generates a zero at a position of a second pole. As a result, the phase margin is improved by compensation effect.

Figure 4A:
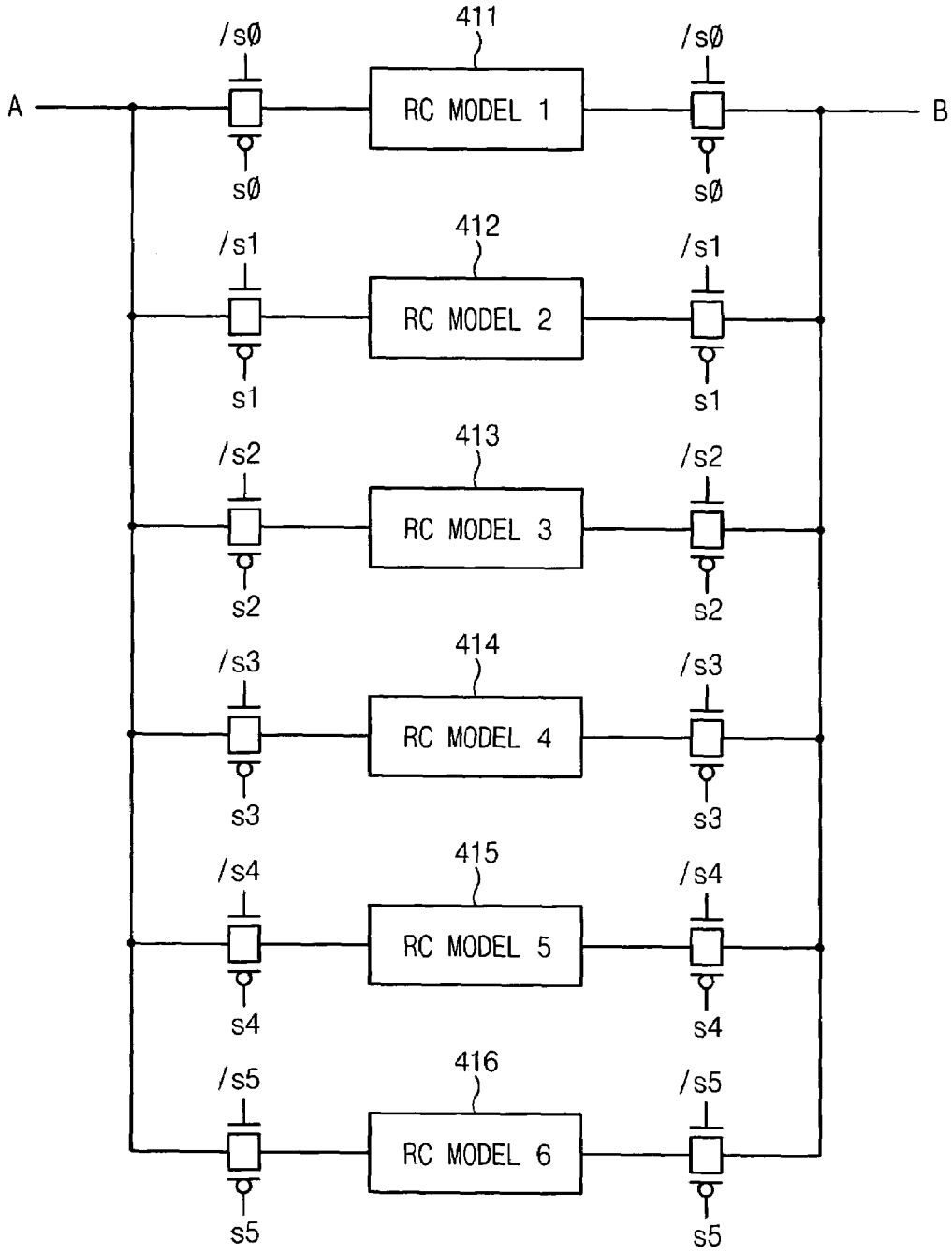
FIG. 4*a* is a circuit diagram illustrating a RC selection unit of FIG. 3.

FIG. 4*a* is a circuit diagram illustrating the RC selection unit 410 of FIG. 3. A plurality of RC models 411~416 are connected in parallel between input and output terminals. One of the plurality of RC models is selected in response to externally inputted control signals s0~s5, and the selected RC model is connected between the terminals A and B.

Figure 4B:
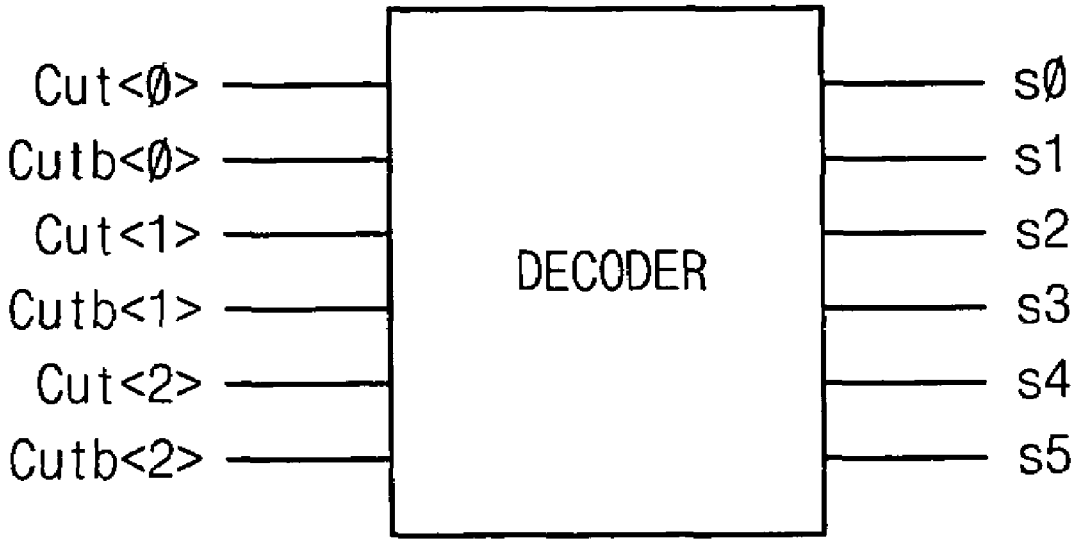
FIG. 4*b* is a block diagram illustrating a RC selection controller of FIG. 2.

FIG. 4*b* is a block diagram illustrating the RC selection controller 130 of FIG. 2. The RC selection controller 130 receives a plurality of control signals cut<0:2> and cutb<0:2>, and outputs the control signal s<0:5>. For example, when s0 is "low" and the rest signals are "high", the RC mode 1 411 is connected between the terminals A and B.

Figure 5A:
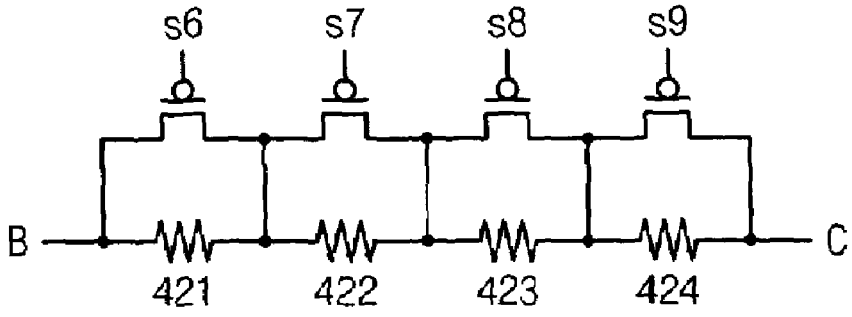
FIG. 5*a* is a circuit diagram illustrating an R selection unit of FIG. 3.

FIG. 5*a* is a circuit diagram illustrating the R selection unit 420 of FIG. 3. The R selection unit 420 comprises a plurality of resistors 421~424 connected in series. The two terminals of each resistor are connected to sources and drains of each PMOS transistor, respectively. Gates of each PMOS transistor are connected to control signals s6~s9 for controlling resistance between terminals B and C. For example, when the control signal s6 is "high" and the rest signals are "low", only a resistor 421 is connected between the terminals B and C.

Figure 5B:
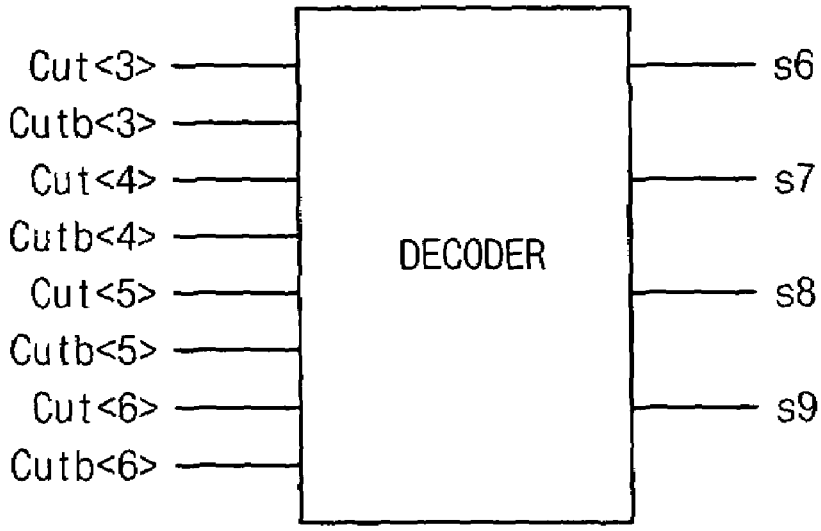
FIG. 5*b* is a block diagram illustrating an R selection controller 230 of FIG. 2.

FIG. 5*b* is a block diagram illustrating the R selection controller 230 of FIG. 2. The R selection controller 230 receives a plurality of control signals cut<3:6>and cutb<3:6>, and decodes the signals by a predetermined method to output control signals s<6:9>.

Figures 6A, 6B:
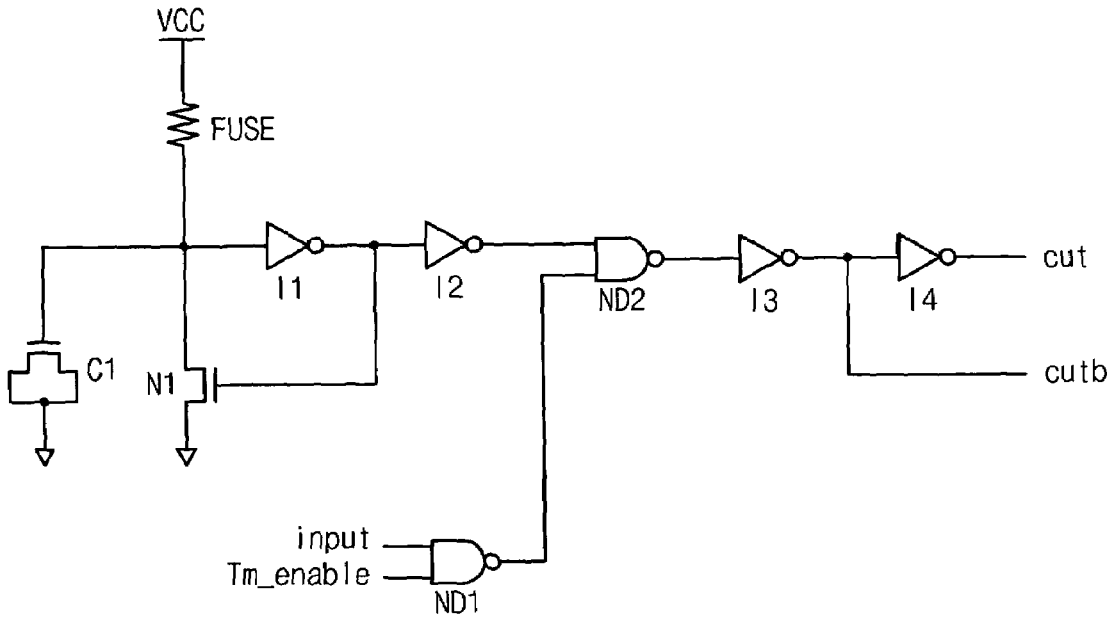
FIG. 6*a* is a circuit diagram illustrating a fuse tuning unit of FIG. 2.
FIG. 6*b* is a logic table illustrating the fuse tuning unit of FIG. 2.

FIG. 6*a* is a circuit diagram illustrating the fuse tuning unit 120 and 220 of FIG. 2. The fuse tuning unit 120 and 220 comprise the NMOS transistor N1, the capacitor C1, inverters I1, I2, I3 and I4, and NAND gates ND1 and ND2. A fuse is connected in series between a power VCC and the drain of the NMOS transistor N1. The NMOS transistor has a gate connected to an output terminal of the inverter I1, and a source connected to ground. The capacitor C1 is connected between the drain of the NMOS transistor N1 and ground. The inverters I1 and I2 are connected in series to the drain of the NMOS transistor N1. The NAND gate ND2 receives output signals from the inverter I2 and the NAND gate ND1. The inverters I3 and I4 are connected in series to the output signal from the NAND gate ND2. The NAND gate ND1 receives an input signal 'input' and a control signal Tm_enable. An output signal 'cut' is outputted from the inverter I4, and an output signal 'cutb' is outputted from the inverter I3.

FIG. 6*b* is a logic table illustrating the operation of the fuse tuning units 120 and 220 of FIG. 2. If the fuse is cut, a "low" signal is inputted into the inverter I1. The output signal 'cut' becomes "high", and the output signal 'cutb' becomes "low". On the other hand, when the fuse is connected, a "high" signal is inputted into the inverter I1. If an output signal from the NAND gate ND1 is "high", the output signal 'cut' becomes "low", and the signal 'cutb' becomes "high". The output signals 'cut' and 'cutb' are inputted into the RC selection controller 130 and the R selection controller 230 to select an optimum RC model and an optimum R value.

In the test mode, the fuse is kept connected. As a result, an output signal from the inverter I2 becomes "high", the control signal Tm_enable becomes "high". The output signals 'cut' and 'cutb' may be controlled by the input signal 'input'. Various combinations are tested in the test mode to select an optimum RC model and an optimum R value. After the test mode, the control signal Tm_enable becomes "low". The output signals 'cut' and 'cutb' are outputted depending on the state of the fuse, which is cut or connected according to test results.

Figure 1:
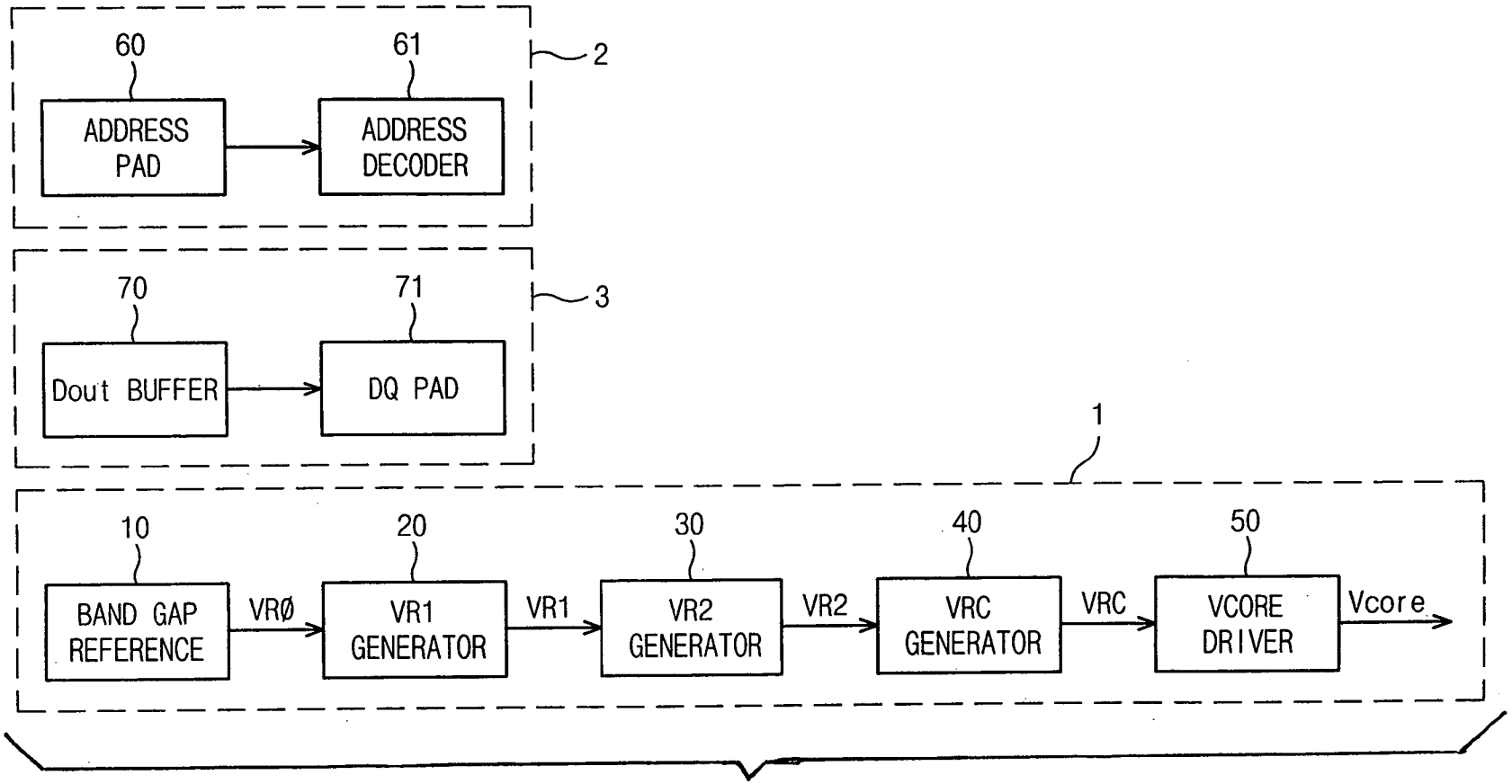
Fig.1 (Prior Art)
FIG. 1 shows a conventional internal voltage generator, a conventional address circuit and a conventional data output circuit, which are separated from each other.
Figure 7:
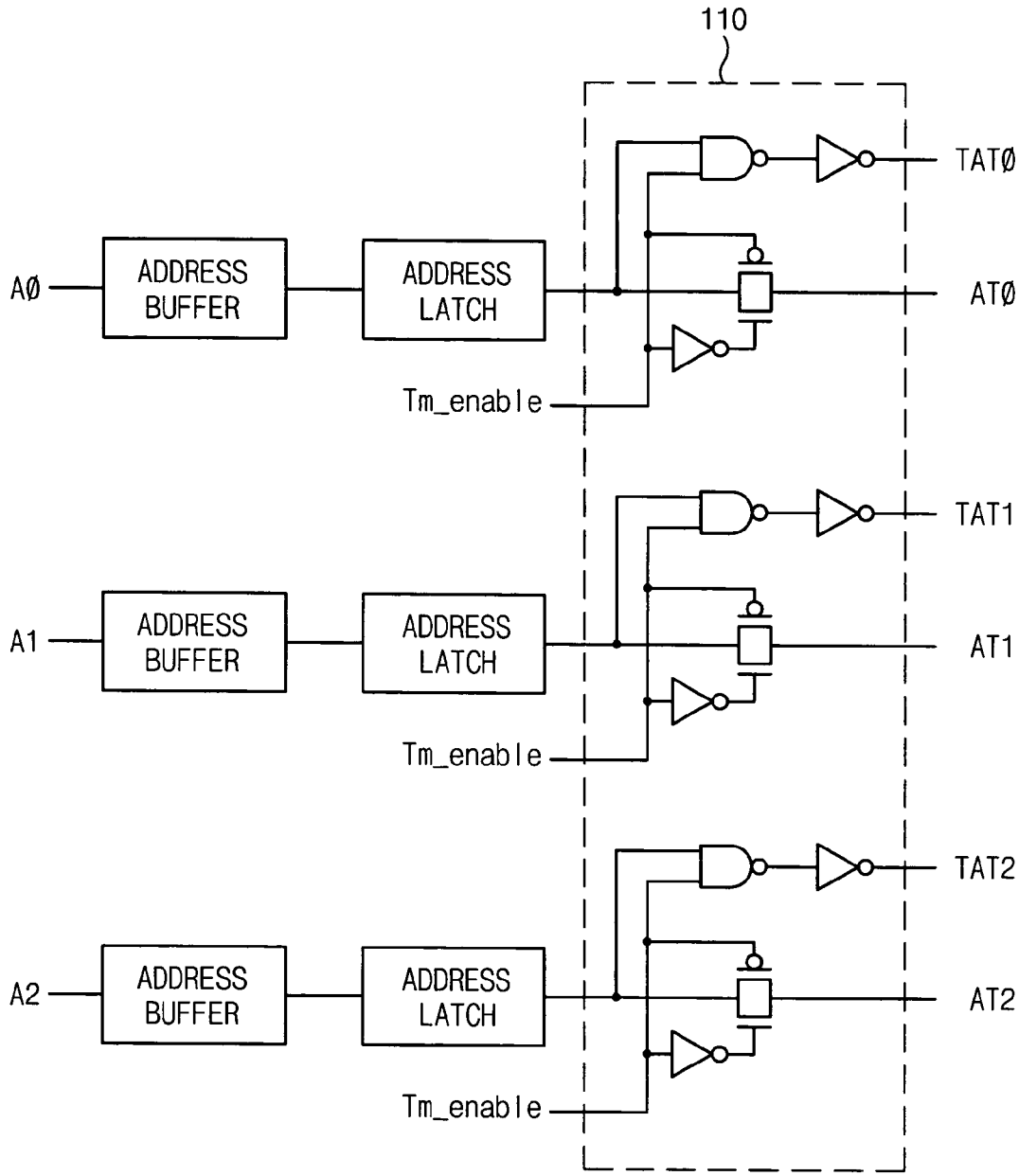
FIG. 7 is a detailed circuit diagram illustrating a demultiplexer in a first test mode block of FIG. 2.

FIG. 7 is a detailed circuit diagram illustrating the demultiplexer 110 in the first test mode block 100 of FIG. 1. In the test mode, the RC selection controller 130 is controlled depending on levels of input signals (A0~A2). The input signals are inputted through the address pads 60*a* and 60*b*. In the test mode, signals inputted through the address pads are used as input signals for test TAT0, TAT1 and TAT2, and outputted into the fuse tuning units 120 and 220. Otherwise, the signals are used as common address signals AT0, AT1 and AT2, and outputted into the address decoder 61*a* and 62*b*.

The configuration of the demultiplexer 210 in the second test mode block 200 is not described because it is the same as that of the demultiplexer 110.

Figure 8:
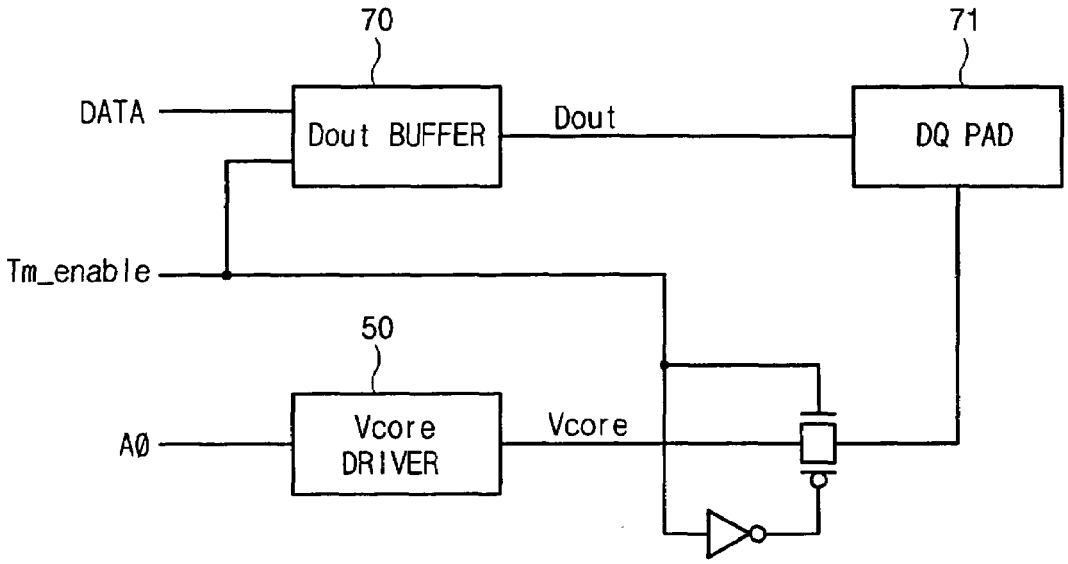
FIG. 8 is a block diagram illustrating a data output circuit of FIG. 2.

FIG. 8 is a block diagram illustrating the data output circuit of FIG. 2. An internal voltage Vcore obtained from test results in the test mode is outputted into the DQ pad 71. For this process, the demultiplexer 310 is provided. In the test mode, the Dout buffer 70 is made to have a high impedance state, and a line where the internal voltage Vcore is outputted is connected to the DQ pad 71.

Otherwise, the line where the internal voltage Vcore is outputted is separated from the DQ pad 71, and the Dout buffer 70 is connected to the DQ pad 71.

In the test mode, the states of signals outputted from the DQ pad 71 varying according to signals provided to the address pads may be maintained. Internal fuses may be programmed to obtain the same output signal as is caused by the input signal which generates an optimum output signal at the DQ pad 71.

Figure 9A:
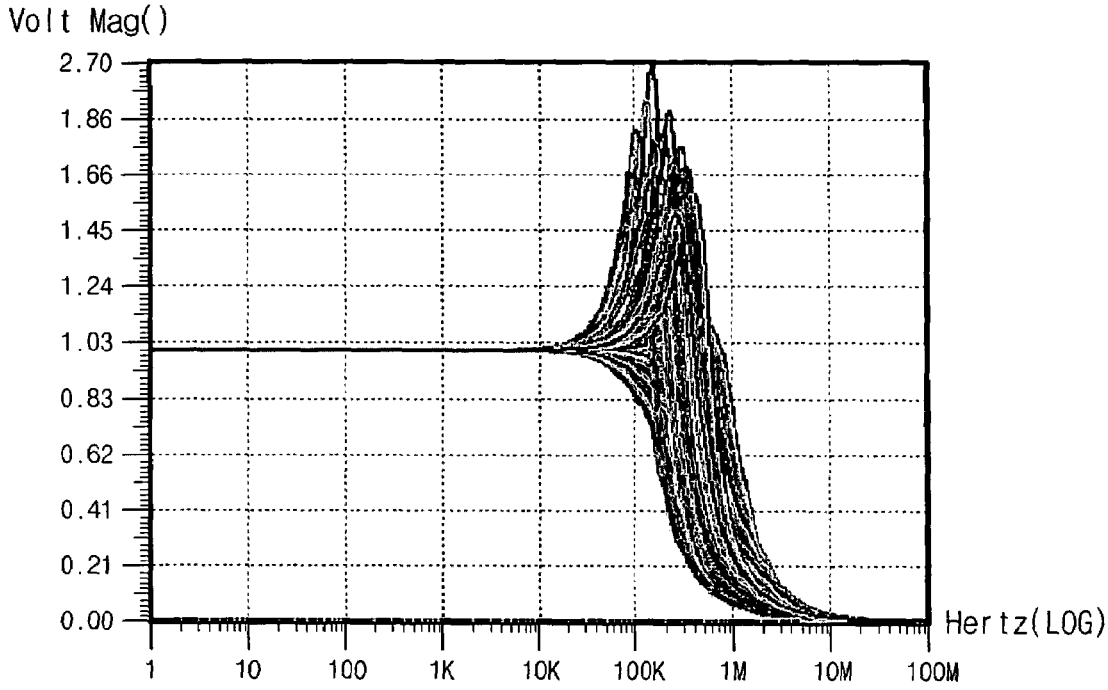
FIGS. 9*a* to 9*c* are graphs illustrating characteristics of the internal voltage generator before tuning.
Figure 9B:
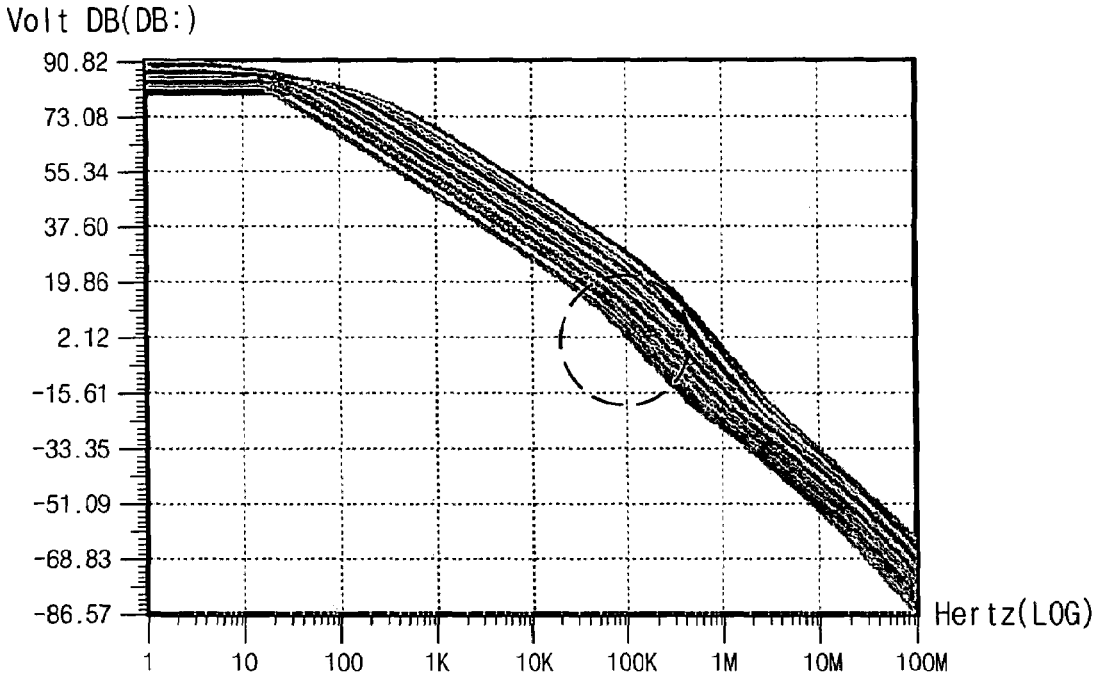
Figure 9C:
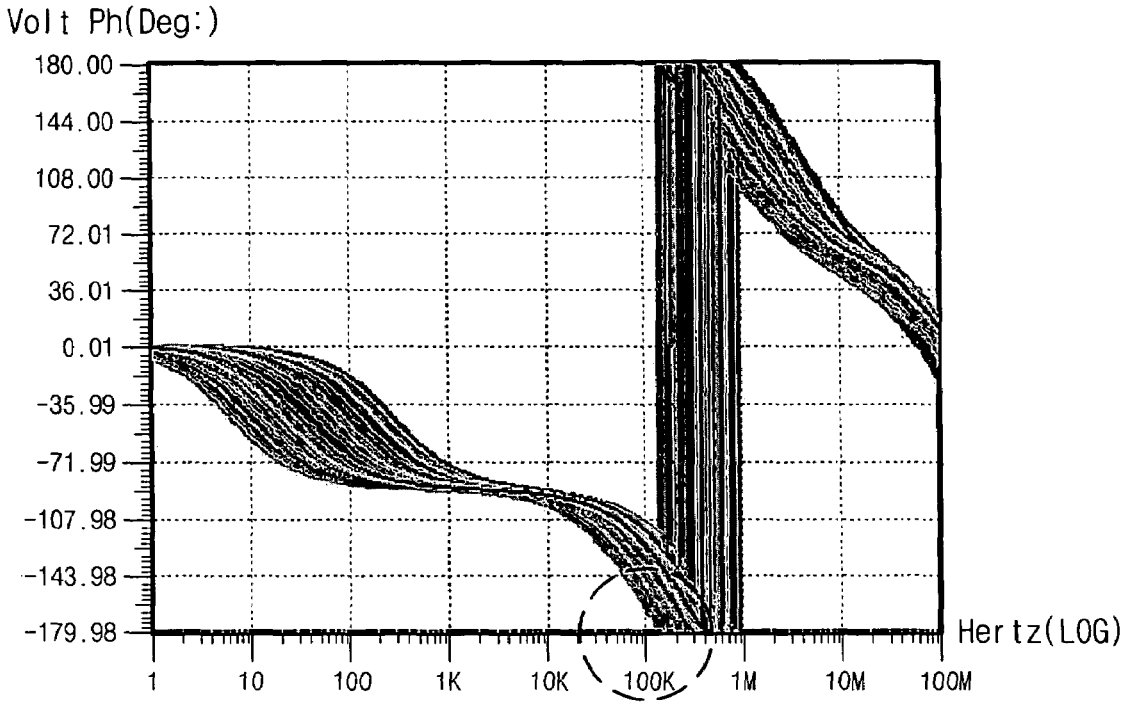

FIGS. 9*a* and 9*c* are graphs illustrating characteristics of internal voltage from the internal voltage generator before tuning. FIG. 9*a* shows a characteristic of the internal voltage in a feedback operation. FIG. 9*b* shows a characteristic of the internal voltage without the feedback operation. When the feedback operation is performed before tuning, ac simulation data shows a high peak in FIG. 9*a*. When the feedback operation is not performed, ac simulation data shows little phase margin in FIG. 9*b*.

Figure 10A:
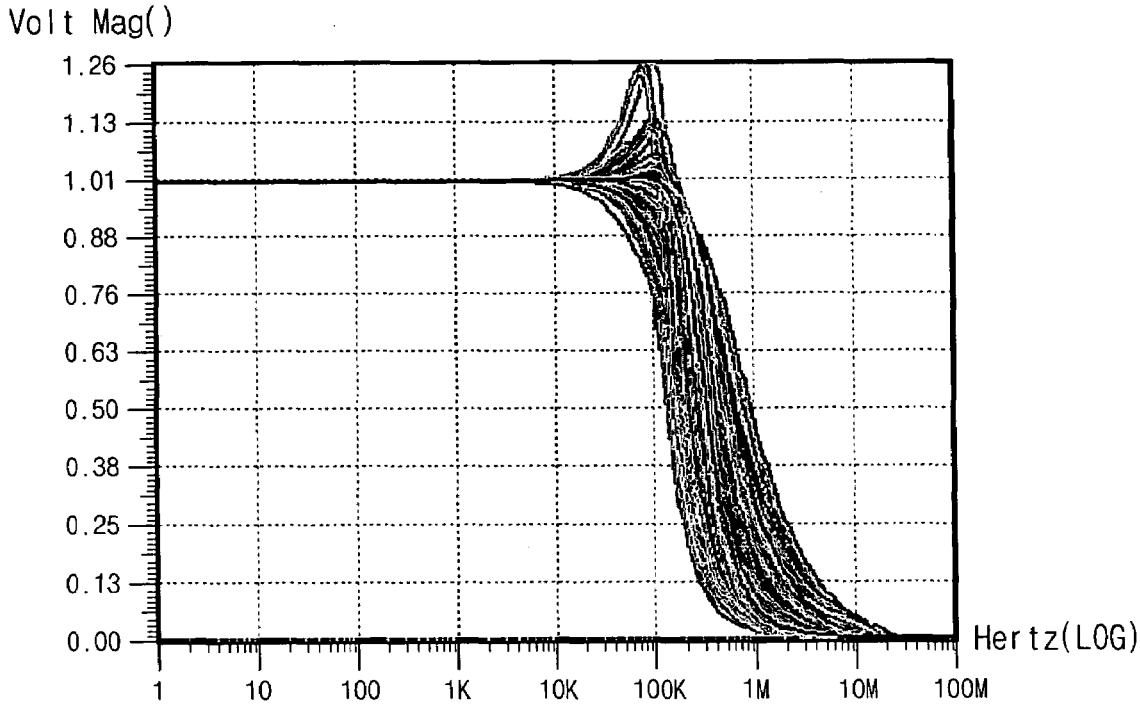
FIGS. 10*a* to 10*c* are graphs illustrating characteristics of the internal voltage generator after tuning.
Figure 10B:
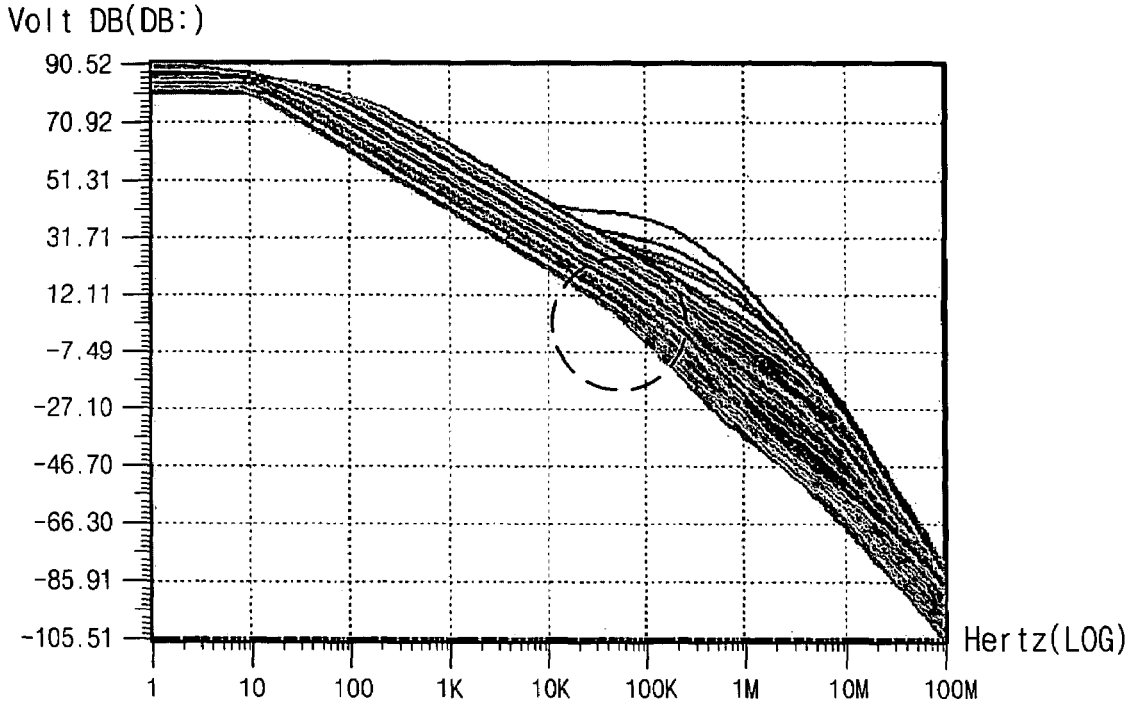
Figure 10C:
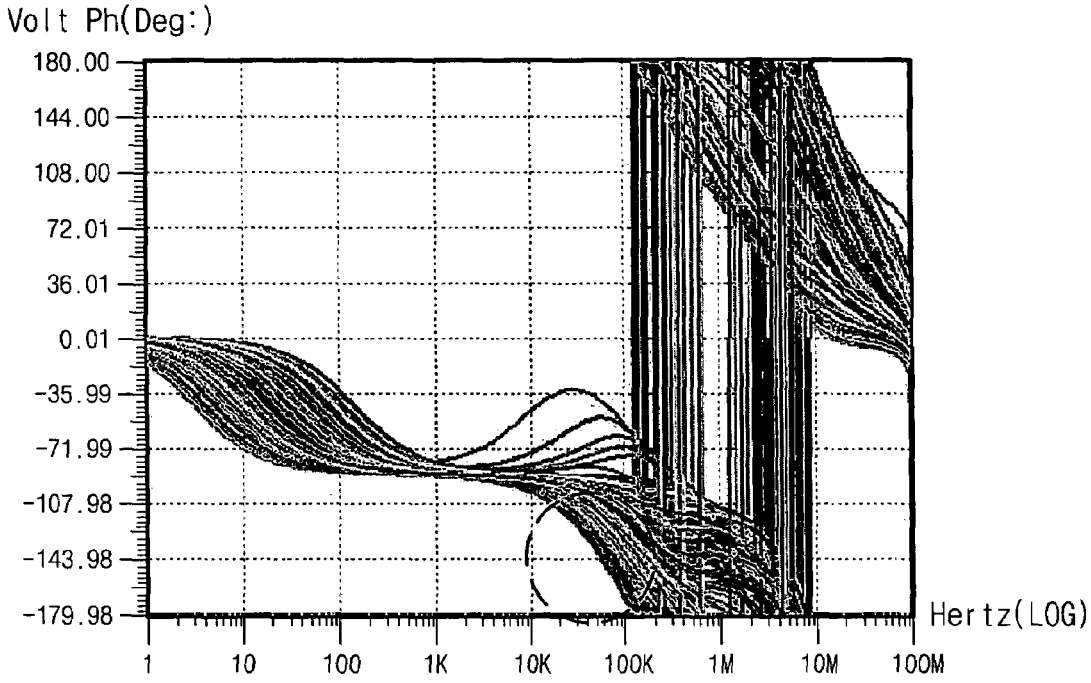

FIGS. 10*a* and 10*c* are graphs illustrating characteristics of internal voltage from the internal voltage generator after tuning. Compared with FIG. 9, the peak of FIG. 10*a* becomes lower, and the phase margin of FIG. 10*b* increases.

Accordingly, an internal voltage generator according to an embodiment of the present invention allows a test to be performed at a package level. In addition, since test results are reflected in fuses, new masks are not required to reflect characteristic regulating results. As a result, production cost and time may be reduced.

What is claimed is:

1. An internal voltage generator of a semiconductor device, comprising:

a tuning unit for receiving a test mode signal, an external signal and a signal stored in an internal setup device, and outputting a control signal;

a characteristic controller for receiving the control signal, and outputting a characteristic controlling signal;

an internal voltage generating unit for receiving a reference input signal and the characteristic controlling signal, and controlling a characteristic of an internal voltage; and a multiplexer for selectively outputting output signals from the internal voltage generating unit and from a data buffer to a data pad in response to the test mode signal, wherein when the test mode signal is activated the level of the control signal is determined by the external signal, and when the test mode signal is inactivated the level of the control signal is determined by the signal stored in the internal setup device.

2. The internal voltage generator according to claim 1, wherein the internal setup device is a fuse.

3. The internal voltage generator according to claim 1, wherein the internal voltage generator further comprises a demultiplexer for receiving the external signal outputted from an address pad, and outputting the external signal into the tuning unit or an address decoder in response to the test mode signal.

4. An internal voltage generator of a semiconductor device, comprising:

a first test mode block for receiving a test mode signal and a first external signal, and outputting a first characteristic control signal;

a second test mode block for receiving the test mode signal and a second external signal, and outputting a second characteristic control signal;

an internal voltage generating unit for receiving a reference input signal, the first characteristic control signal and the second characteristic control signal, and outputting an internal voltage; and a data output unit for receiving the test mode signal, and outputting the internal voltage externally.

5. The internal voltage generator according to claim 4, wherein the first test mode block comprises:

a first tuning unit for receiving the test mode signal, the first external signal and a signal set in a first setup device, and outputting a predetermined control signal; and a first characteristic controller for receiving the predetermined control signal, and outputting the first characteristic control signal.

6. The internal voltage generator according to claim 5, wherein the first setup device is a fuse.

7. The internal voltage generator according to claim 5, wherein the second test mode block comprises:

a second tuning unit for receiving the test mode signal, the second external signal and a signal set in a second setup device, and outputting a second predetermined control signal; and a second characteristic controller for receiving the second predetermined control signal, and outputting the second characteristic control signal.

8. The internal voltage generator according to claim 7, wherein the second setup device is a fuse.

9. The internal voltage generator according to claim 4, wherein the internal voltage generating unit comprises:

a first amplifier for receiving the reference input signal;

a second amplifier for receiving an output signal from the first amplifier;

a first characteristic controller, connected between input/output terminals of the second amplifier, for receiving the first characteristic control signal;

a second characteristic controller, connected between the output terminal of the second amplifier and an output terminal of the internal voltage generating unit, for receiving the second characteristic control signal; and a capacitor connected between the output terminal of the internal voltage generating unit and ground.

10. The internal voltage generator according to claim 9, wherein the first characteristic controller comprises a plurality of RC models connected in parallel between the input/output terminals wherein each of the plurality of RC models comprises a resistor and a capacitor connected in series.

11. The internal voltage generator according to claim 9, wherein the second characteristic controller comprises a plurality of resistors whose equivalent resistance is controlled by the second characteristic control signal.

* * * * *